United States Patent [19]

Norris et al.

[11] 4,255,938

[45] Mar. 17, 1981

[54] WATER BOILER/VENTURI COOLER

[75] Inventors: Dean E. Norris; John R. Welling, both of Scottsdale, Ariz.

[73] Assignee: Motorola Inc., Schaumburg, Ill.

[21] Appl. No.: 21,642

[22] Filed: Mar. 19, 1979

[51] Int. Cl.[3] ..... F25B 19/00

[52] U.S. Cl. ..... 62/268; 137/15.2; 239/171; 239/431

[58] Field of Search ..... 62/100, 268, 61; 137/15.2; 239/171, 422, 426, 427, 427.3, 427.5, 430, 431

[56] References Cited

U.S. PATENT DOCUMENTS

| | | | |
|---|---|---|---|
| 1,370,197 | 3/1921 | Bolotoff | 239/431 |
| 3,429,507 | 2/1969 | Jones | 239/171 |
| 3,456,871 | 7/1969 | Gosling | 137/15.2 |
| 3,702,619 | 11/1972 | Son | 239/430 |
| 3,911,260 | 10/1975 | Dustin | 137/15.2 |
| 4,061,483 | 12/1977 | Burg | 62/268 |

*Primary Examiner*—Ronald C. Capossela

*Attorney, Agent, or Firm*—M. David Shapiro; Eugene A. Parson

[57] ABSTRACT

A converging/diverging venturi assembly positioned in a subsonic fluid flow stream for producing a supersonic flow velocity in the downstream diverging section with a pressure pickoff system that is located adjacent a minimum static pressure location just prior to a point where shock waves begin to form. The low pressure in the supersonic region in front of the shock wave may be utilized for reducing the boiling temperature of a fluid in a boiler by porting a tube from the low pressure venturi to the boiler, thus improving the heat transfer characteristics of the boiler where the boiler is used for a heat sink for heat sources in a mobile vehicle.

5 Claims, 1 Drawing Figure

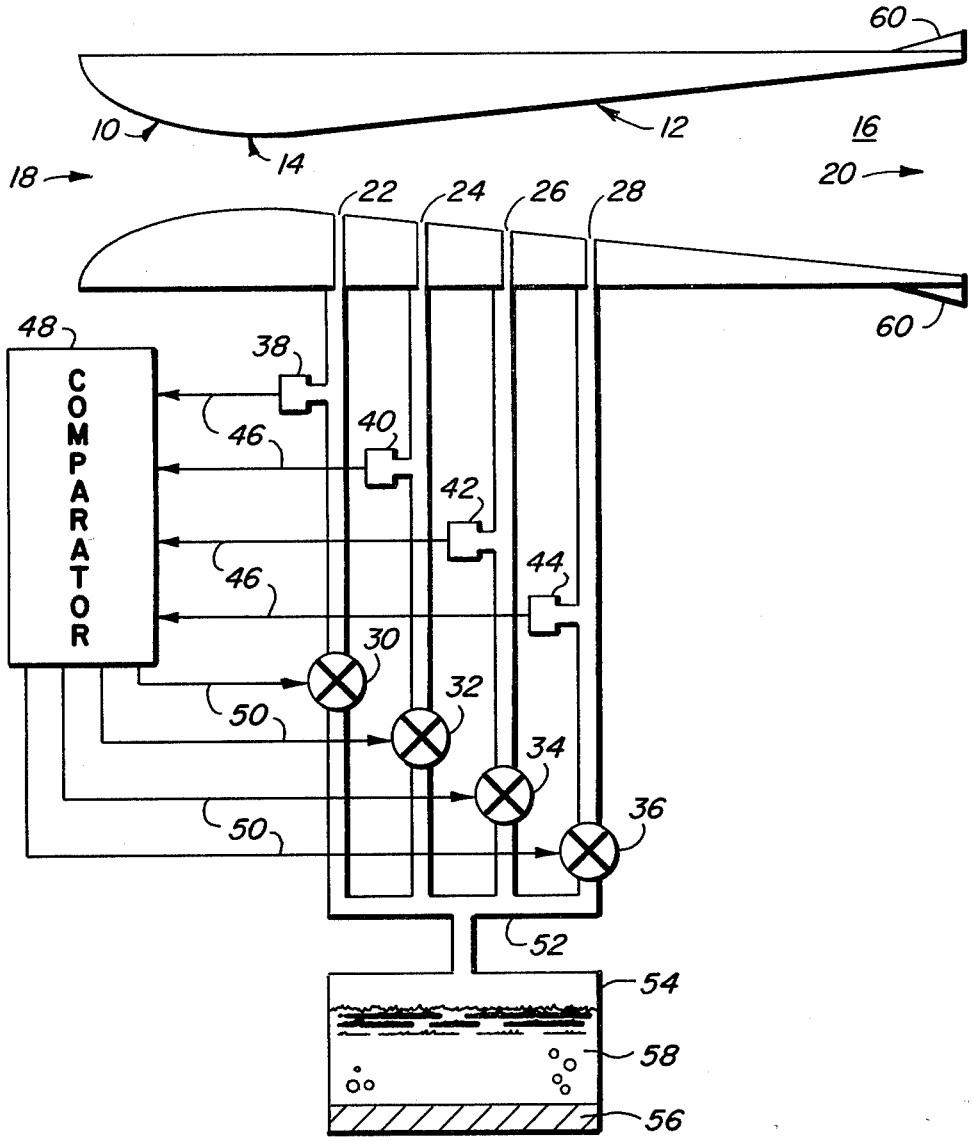
60
10
12
16
14
18
20
22
24
26
28
60
48
COMPARATOR
38
40
42
44
46
46
30
32
34
36
50
50
52
54
58
56

WATER BOILER/VENTURI COOLER

FIELD OF THE INVENTION

The invention relates to an improved configuration of a venturi assembly for providing a lower than ambient static fluid pressure.

BACKGROUND OF THE INVENTION

Venturi system for producing pressures lower than ambient static pressure typically locate the low pressure tap in the neck or throat of a converging/diverging section configuration. Fluid flow velocity in the neck region is limited to Mach 1 so that the pressure may never go below a level established by the Mach 1 velocity limit.

When the venturi low pressure tap is used to lower the boiling temperature of a coolant liquid, it has been the practice to use low boiling temperature coolants, such as those in the "Freon" family. Freon 11 is commonly used because it has a lower boiling temperature than, for example, water, at a given pressure level. However, the heat of vaporization of Freon, or of other liquids, do not compare favorably with that of water. The basic problem in substitution of water as the coolant is that the boiling temperature is generally higher than a desirable temperature for coolant usage.

SUMMARY OF THE INVENTION

These and other problems and shortcomings of the prior art are resolved by the present invention in that a venturi having both converging and diverging sections with a neck or throat section therebetween is used to generate Mach 1 flow in the neck section with subsequent supersonic flow velocity downstream. A shock wave is formed beyond the supersonic region. A low pressure static inlet is located in the wall of the venturi adjacent the supersonic flow region to generate a lower pressure in the static inlet than that available absent the adjacent supersonic flow. This lower pressure may be used in a closed boiler to reduce the boiling temperature of a coolant contained therein, thereby providing heat transfer enhanced by the heat of vaporization of the boiling coolant. When the boiling coolant temperature is thus reduced, it becomes more useful as a coolant or heat sink for such as electronics circuits, which may not perform adequately at higher temperatures. The invention is especially useful, but not limited to, airborne vehicles which operate at velocities approximating Mach 0.5, or greater.

Therefore, it is an object of the invention to generate lower pressure in a venturi static inlet located adjacent a supersonic flow region when the ambient flow is at or exceeds Mach 0.5.

It is another object of the invention to utilize a converging/diverging venturi apparatus to generate a supersonic flow therein.

It is still another object of the invention to utilize a converging/diverging venturi apparatus to generate a low pressure in a venturi inlet thereof adjacent a supersonic velocity region for reducing the boiling temperature of a coolant liquid contained in a boiler connected to the low pressure inlet source.

These and other objects of the instant invention will become more clearly understood upon study of the Detailed Description of the Invention, below, together with the drawing of the invention which diagrammatically depicts a cross-section of a preferred embodiment of the invention.

DETAILED DESCRIPTION OF THE INVENTION

Referring to the drawing, it will be seen that converging section 10, diverging section 12 and neck or throat section 14 comprise venturi 16. Venturi 16 has air or fluid input 18 and output 20. Converging section 10, diverging section 12 and neck or throat section 14 combine to provide supersonic flow velocity downstream of venturi throat 14. The supersonic flow velocity may occur in the vicinity of any of inlets 22, 24, 26, 28, any of which may be selected to minimize pressure by means of the selection. Of course, greater or fewer inlets may be provided than the four shown in the drawing and, in some system cases, optimum selection of inlet location may preclude the necessity of providing a plurality of inlets. That is, where venturi input flow Mach number is controllable or predictable within essentially narrow predetermined limits, a single inlet may provide satisfactory pressure therein over the full operating range. On the other hand, where the operating parameters are too broad to provide satisfactory pressure levels within a single inlet over the range of the velocity and temperature environments, it may be necessary to provide multiple inlets, as shown. A tube is connected to each of inlets 22–28 and each tube is supplied with corresponding pressure sensor 38–44. The tubes continue from pressure sensors 38–44 to valves 30–36. Beyond valves 30–36, the tubes are manifolded 52 into boiler 54. Pressure sensor 38–44 electrical outputs are fed via wires 46 to comparator 48. Of four wire inputs 46, comparator 48 picks the one corresponding to the lowest pressure from sensors 38–44 and activates the corresponding valve from valves 30–36 via one of wires 50. By this means, the lowest pressure is selected from inlets 22–28 and is applied to boiler 54, thus lowering the pressure and, hence, the boiling temperature of fluid coolant 58 to a minimum temperature. Coolant 58 then serves to cool electronic package 56, or the like, which is fastened in a heat transfer relationship to boiler 54.

The nozzle relationships are quite complex, however, considering that when air expands, mass continuity must be maintained and therefore air velocity, or Mach number, must increase. The relationship for isentropic flow with a perfect gas is $$P_o = P\left(1 + \frac{\gamma - 1}{2} M^2\right)$$

where

P = static pressure, $P_o$ = total pressure (constant for isentropic flow), $\gamma$ = specific heat ratio = 1.4 for air, and M = local Mach number.

Thus in the diverging section of nozzle 12 the static pressure decreases as the Mach number (velocity) increases. Where sea level air pressure of 14.7 PSIA must be reduced to as little as 4.52 PSIA, because of system requirements, a single diverging nozzle section is not appropriate. The converging/diverging nozzle assembly, as shown in the drawing, is required. The nozzle of the drawing allows two phenomena to occur:

(1) a velocity of M = 1 in choked throat 14 with subsonic input Mach numbers, and (2) an ability to expand the air leaving the throat to supersonic speeds, that is; higher nozzle velocity, $M>1$ (and consequently, lower pressure), than in a plain converging nozzle.

One limitation in designing with a converging-/diverging nozzle (venturi) for vehicle applications is that the venturi inlet and outlet free air stream pressures are nominally equal. When building up the converging-/diverging nozzle Mach number so that choke flow exists at the neck and eventual expansion can occur, the pressure must ultimately return to the free stream value. The phenomena which accomplishes this is the shock wave. The point in the nozzle in which the shock wave occurs varies with input nozzle 10 air conditions 18 (altitude and Mach number). Therefore, for a vehicle flight envelope the nozzle shock wave can be expected to move longitudinally back and forth in nozzle 12. The significance of this is that to pick up the lowest nozzle pressure (which is applied to the water boiler) it is necessary that the pressure pickoff be just prior to (upstream of) the shock. Therefore, several pressure pickoffs may be incorporated in the diverging nozzle with intelligent interpretation of the lowest pressure and capability of switching the boiler to the correct or lowest pressure pickoff. This may be accomplished by means of valving 30–36 controlled by pressure sensors 38–44 via comparator 48, as set forth above.

Venturi 16 may have a rectangular, circular or other cross section. It is believed that a circular cross section produces the most efficient operation in terms of pressure differential between inlet 22 (or 24–28) and the static pressure in free stream 18, 20, outside venturi 16.

It is of interest to note that the boiling temperature of water is 70° C. at a 30,000 foot altitude. If the 70° C. temperature is adequate for system cooling purposes, there would be no reason to reduce boiler 54 pressure below the normal pressure for this altitude. Since this may frequently be the case, it becomes apparent that the problem most needing solution is for vehicle operation at lower altitudes. Also, at velocities above Mach 0.5, it is easier to accomplish the 4.52 PSIA boiler pressure required to reduce water boiling temperature to 70° C. The instant invention provides a 70° C. water boiling temperature at altitudes between approximately 5,000 feet and 30,000 feet and input or free stream fluid velocities down to approximately Mach=0.5. Operation of the venturi may be enhanced by addition of spoiler 60 at diverging section 12 exit. Spoiler 60 provides a lower static pressure at the outlet of diverging section 12 of venturi 16. This increases the velocity of the supersonic flow within diverging section 12, moves the shock nearer to exit 20 and thereby serves to reduce the pressure in inlets 22–28 even further.

While the invention has been particularly shown and described with reference to a preferred embodiment thereof, it will be understood by those skilled in the art that various other modifications and changes may be made to the present invention from the principles of the invention described above without departing from the spirit and scope thereof, as encompassed in the accompanying claims.

Therefore, it is intended in the appended claims to cover all such equivalent variations as come within the scope of the invention as described.

We claim:

1. An improvement in a system for cooling a heat source, the cooling system being adapted for use in a liquid flow stream, the cooling system comprising:

a boiler, the heat source being in heat energy communication with said boiler; and a refrigerant being contained within said boiler;

the improvement comprising:

a venturi further comprising:

an upstream converging section;

a downstream diverging section;

a throat section between and joining said upstream and downstream sections; and at least one venturi static inlet means for producing an inlet pressure, said at least one venturi statis inlet means being connected between said boiler and a region of said venturi being responsive to the liquid flow stream to produce a higher flow velocity of the liquid flow stream, said inlet pressure being lower than an ambient free stream pressure responsive to said higher flow velocity.

2. The improved system according to claim 1 wherein said refrigerant is water.

3. The improved system according to claim 1 wherein a shock wave is generated in said downstream diverging section and said higher flow velocity is supersonic in a region of said venturi immediately upstream of said shock wave.

4. The improved system according to claim 3 wherein said refrigerant is water.

5. The improved system according to claim 3 wherein said at least one venturi static inlet means comprises a plurality of said inlet means, each of said plurality of said inlet means being located in a different location in said venturi, the improvement further comprising:

means for selecting one of said plurality of inlet means responsive to a lowest pressure present in said selected inlet means.

* * * * *